US009261301B2

(12) United States Patent
Foy

(10) Patent No.: US 9,261,301 B2
(45) Date of Patent: Feb. 16, 2016

(54) VEHICLE-TRANSPORTABLE ICE PLANT

(71) Applicant: M & M Electric Service, Inc., Gastonia, NC (US)

(72) Inventor: Marvin Scott Foy, Gastonia, NC (US)

(73) Assignee: M & M ELECTRIC SERVICE, INC., Gastonia, NC (US)

( * ) Notice: Subject to any disclaimer, the term of this patent is extended or adjusted under 35 U.S.C. 154(b) by 207 days.

(21) Appl. No.: 13/903,340

(22) Filed: May 28, 2013

(65) Prior Publication Data

US 2014/0352346 A1 Dec. 4, 2014

(51) Int. Cl.

| | |
|---|---|
| ***B60H 1/32*** | (2006.01) |
| ***B60H 1/00*** | (2006.01) |
| ***F25C 5/00*** | (2006.01) |
| ***F25C 1/00*** | (2006.01) |
| ***F25C 1/12*** | (2006.01) |

(52) U.S. Cl.
CPC ... *F25C 1/00* (2013.01); *F25C 1/12* (2013.01); *F25C 2400/12* (2013.01)

(58) Field of Classification Search
CPC ..... F25C 5/002; F25C 5/007; F25C 5/18; F25C 5/182; F25C 1/00; B60H 1/32; B60H 1/00014; B60H 1/00264; B60H 1/3229; B60H 1/00507; B60H 1/00535
USPC ..... 254/122–126, 128, 93 R, 93 L
See application file for complete search history.

(56) References Cited

U.S. PATENT DOCUMENTS

| | | | | |
|---|---|---|---|---|
| 3,341,042 | A * | 9/1967 | Carder | 414/471 |
| 3,806,092 | A * | 4/1974 | Richards | 254/122 |
| 4,923,237 | A * | 5/1990 | Kiefer et al. | 296/24.35 |
| 4,992,699 | A | 2/1991 | Parmley | |
| 2004/0003621 | A1* | 1/2004 | Zevlakis | 62/352 |
| 2004/0083752 | A1* | 5/2004 | Sanders | 62/344 |
| 2007/0245756 | A1* | 10/2007 | Gill | 62/237 |
| 2012/0111004 | A1* | 5/2012 | Conry | 60/641.2 |
| 2012/0277010 | A1 | 11/2012 | Bilsen et al. | |
| 2013/0180267 | A1* | 7/2013 | Hartig et al. | 62/62 |

FOREIGN PATENT DOCUMENTS

| | | |
|---|---|---|
| WO | 2011 055163 A1 | 5/2011 |
| WO | 2013 019700 A1 | 2/2013 |

OTHER PUBLICATIONS

International Search Report dated Sep. 30, 2014 for International PCT Application No. PCT/US14/37965.

* cited by examiner

*Primary Examiner* — Frantz Jules
*Assistant Examiner* — Erik Mendoza-Wilkenfel
(74) *Attorney, Agent, or Firm* — Shumaker, Loop & Kendrick, LLP

(57) ABSTRACT

A vehicle transportable ice plant includes a transportable trailer including an enclosure, and an evaporator positioned within the enclosure for supplying supercooled refrigerant to a heat exchanger, a compressor downstream from the evaporator for compressing the refrigerant, a discharge line downstream from the compressor for discharging compressed refrigerant to a condenser, a condenser fan for removing heat from the condenser, and a thermostatic expansion valve for delivering supercooled refrigerant to the evaporator in an endless cycle. An ice production brings water into contact with the evaporator heat exchanger to produce ice, and an ice cube maker is provided for producing ice cubes from the ice.

9 Claims, 6 Drawing Sheets

VEHICLE-TRANSPORTABLE ICE PLANT

TECHNICAL FIELD AND BACKGROUND OF THE INVENTION

The present invention relates to a transportable ice plant, particularly one that is transportable by a vehicle such as over-the-road tractor. The plant is contained within a trailer, and the trailer is attachable to the tractor in the usual manner. The ice plant is capable of using raw water from virtually any water supply, including rivers, lakes and ponds, and producing sanitary water and ice. The plant has particular application in remote locations, such as mines, where regulations require that mine workers be supplied with large quantities of ice, as well as sporting events, disaster locations and the like. The ice plant is adapted for dispensing ice in bulk form and also in bags.

SUMMARY OF THE INVENTION

It is therefore an object of the present invention to provide a transportable ice plant.

It is another object of the invention to provide a transportable ice plant that is self-contained.

It is another object of the invention to provide a transportable ice plant that is adaptable to over-the-road travel conditions, including the ability to travel under all standard highway overpasses on route to its use location.

These and other objects and advantages of the invention are achieved by providing a vehicle transportable ice plant, that includes a transportable trailer including an enclosure, an evaporator positioned within the enclosure for supplying supercooled refrigerant to a heat exchanger, a compressor downstream from the evaporator for compressing the refrigerant, a discharge line downstream from the compressor for discharging compressed refrigerant to a condenser, a condenser fan for removing heat from the condenser, and a thermostatic expansion valve for delivering supercooled refrigerant to the evaporator in an endless cycle. An ice production apparatus is provided for bringing water into contact with the evaporator heat exchanger to produce ice. An ice cube maker is provided for producing ice cubes from the ice.

According to another embodiment of the invention, the condenser is mounted outside the trailer on a condenser lift that is adapted to move the condenser between a lowered, transport position in relation to the height of the trailer to permit passage of the trailer beneath highway overpasses and a raised, use position in relation to the height of the trailer to permit backflow of the refrigerant from the condenser when the condenser is not operating.

According to another embodiment of the invention, a reservoir is provided for storing the refrigerant when the condenser is not operating.

According to another embodiment of the invention, the condenser lift includes a platform mounted on a frame carried by the trailer, and includes a scissor-type lift mounted under the condenser on a base carried by the trailer for moving the lift vertically.

According to another embodiment of the invention, the frame includes a plurality of guide rails extending upwardly from the base and engaging the platform to guide its vertical travel.

According to another embodiment of the invention, the condenser extends above an upper extent of the trailer when in the raised, use position.

According to another embodiment of the invention, the condenser extends below an upper extent of the trailer when in the lowered transport position.

According to another embodiment of the invention, the condenser extends above an upper extent of the trailer when in the raised, use position and the condenser extends below an upper extent of the trailer when in the lowered transport position.

According to another embodiment of the invention, the guild rails comprise four guide rails adapted to be attached to the condenser platform when the condenser is in the raised, use position to support the condenser platform in the raised, use position.

According to another embodiment of the invention, at least one cross-brace is attached to and extending diagonally and laterally between at least two of the guide rails to provide anti-racking support to the guide rails and condenser.

According to another embodiment of the invention, a vehicle transportable ice plant is provided that includes a transportable trailer including an enclosure, an evaporator positioned within the enclosure for supplying supercooled refrigerant to a heat exchanger, a compressor downstream from the evaporator for compressing the refrigerant, a discharge line downstream from the compressor for discharging compressed refrigerant to a condenser, a condenser fan for removing heat from the condenser, and a thermostatic expansion valve for delivering supercooled refrigerant to the evaporator in an endless cycle. The condenser is mounted outside the trailer on a condenser lift that is adapted to move the condenser between a lowered, transport position in relation to the height of the trailer to permit passage of the trailer beneath highway overpasses and a raised, use position in relation to the height of the trailer to permit backflow of the refrigerant from the condenser when the condenser is not operating. A platform is mounted on a frame carried by the trailer, and a plurality of guide rails extend upwardly from a base and engage the platform to guide its vertical travel. A scissor-type lift is mounted under the condenser on a base carried by the trailer for moving the lift vertically. An ice production apparatus is positioned in the trailer for bringing water into contact with the evaporator heat exchanger to produce ice, and an ice cube maker is provided for producing ice cubes from the ice.

BRIEF DESCRIPTION OF THE DRAWING FIGURES

The present invention is best understood when the following detailed description of the invention is read with reference to the accompanying drawings, in which.

DETAILED DESCRIPTION OF THE PREFERRED EMBODIMENT

Figure 1:
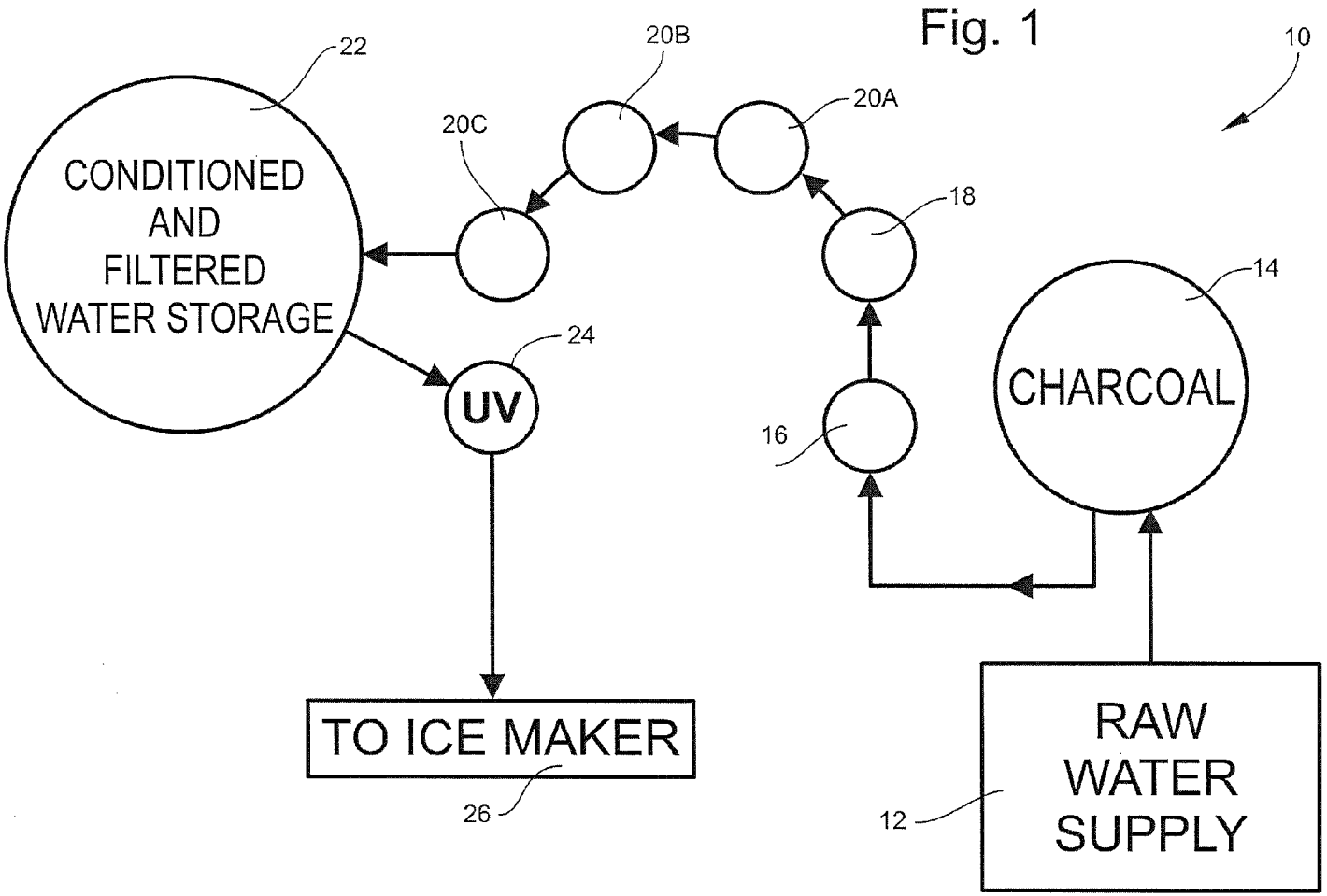
FIG. 1 is a schematic of a water purification section of an ice plant according to one embodiment of the invention.

Referring now specifically to the drawings, a purification section 10 of an ice maker is shown. Raw water, which may be from a raw water supply 12, such as a municipal water system, well, lake, pond, river or tanker truck, among other sources, is delivered to a charcoal filter 14 for primary filtration, then to a UV filter 16, a carbon filter 18, several reverse osmosis filters 20A-C, and then to a storage tank 22. At this stage, the water is conditioned and filtered. Water from the storage tank is then delivered on demand to a UV filter 24, which delivers the water to the ice maker 26.

Figure 2:
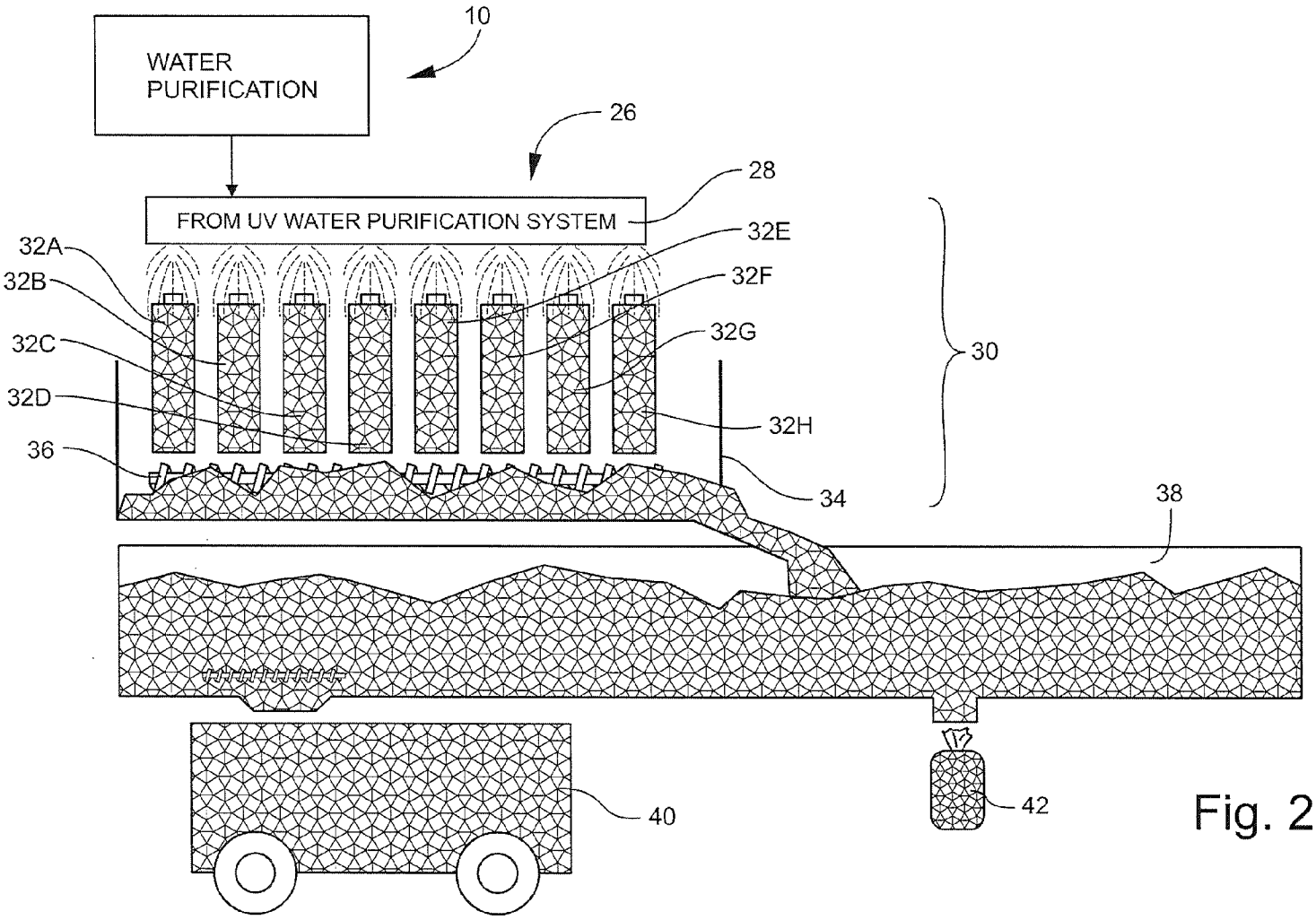
FIG. 2 is a further schematic view showing ice production and movement of ice to either a bulk or bag ice location.

As shown in FIG. 2, water from the purification section 10 is delivered to a manifold 28 from which the water delivered to the ice making machine 30 where it is cascaded over a series of supercooled steel cylinders 32A-H. Contact between the water and the surface of the cylinders 32A-H causes almost instantaneous freezing. Heat on the inside of the cylinders 32A-H loosens the ice, causing it to fall into a trough 34 underneath the cylinders 32A-H where it is delivered by an auger 36 to a storage bin 38. The ice may be stored until dispensed, either into a bulk container such as a cart 40 or into bags at a bagging station 42.

The above description is merely illustrative of several different processes for manufacturing cubed ice, and is not intended as limiting the invention. If water of sufficient purity is available, it can be delivered directly to the ice making machine 30.

Referring now to FIGS. 3-6, the water purification section 10 and ice making machine 30 are housed in a over-the-road trailer 50, as shown schematically. The trailer 50 includes a chassis frame 52 and a trailer enclosure 54. The trailer 50 also includes a base 56. A refrigerant system 60 includes an evaporator for supplying supercooled refrigerant to a heat exchanger, a compressor downstream from the evaporator for compressing the refrigerant, a discharge line downstream from the compressor for discharging compressed refrigerant and a thermostatic expansion valve for delivering supercooled refrigerant to the evaporator in an endless cycle. These elements are shown collectively and schematically at reference numeral 60 as being positioned in the trailer enclosure 54. One or more condensers 62 are positioned on the exterior of the trailer enclosure 54 and are connected by suitable conduits with the interior components of the refrigerant system 60 positioned on interior of the trailer enclosure 54.

A requirement of the refrigeration system 60 is that the condensers 62 be positioned above the interior components of the refrigeration system 60 so that refrigerant gas backflows when the system is not in operation. This requires that the condenser 62 be positioned at a height substantially above the interior components 60. In turn, this requires that the condenser 62 be positioned above the top of the trailer enclosure 54 in order to achieve this backflow. This position is too high to permit over-the-road travel because of the regulatory requirements for highway overpass heights. Minimum vertical clearance under overhead structures (including over the paved shoulders) is 16 feet (4.88 m) in rural areas and 14 feet (4.27 m) in urban areas, with allowance for extra layers of pavement. Through urban areas at least one routing should have 16-foot (4.88 m) clearances.

Figure 3:
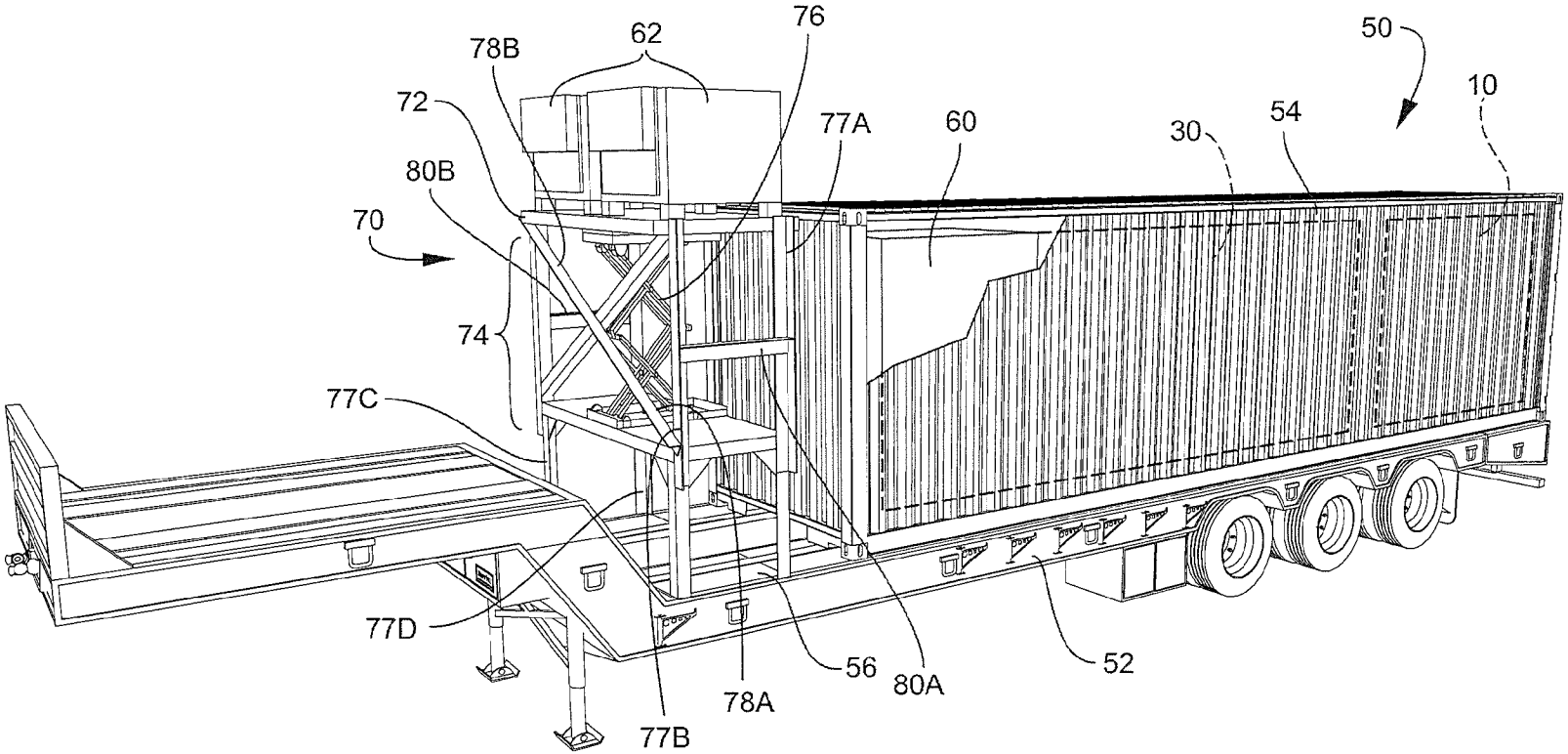
FIG. 3 is a perspective view of a trailer of the general type in which the ice plant can be installed, and showing a novel mechanism for raising the externally-mounted condensers during travel and lowering the condensers for travel.
Figure 4:
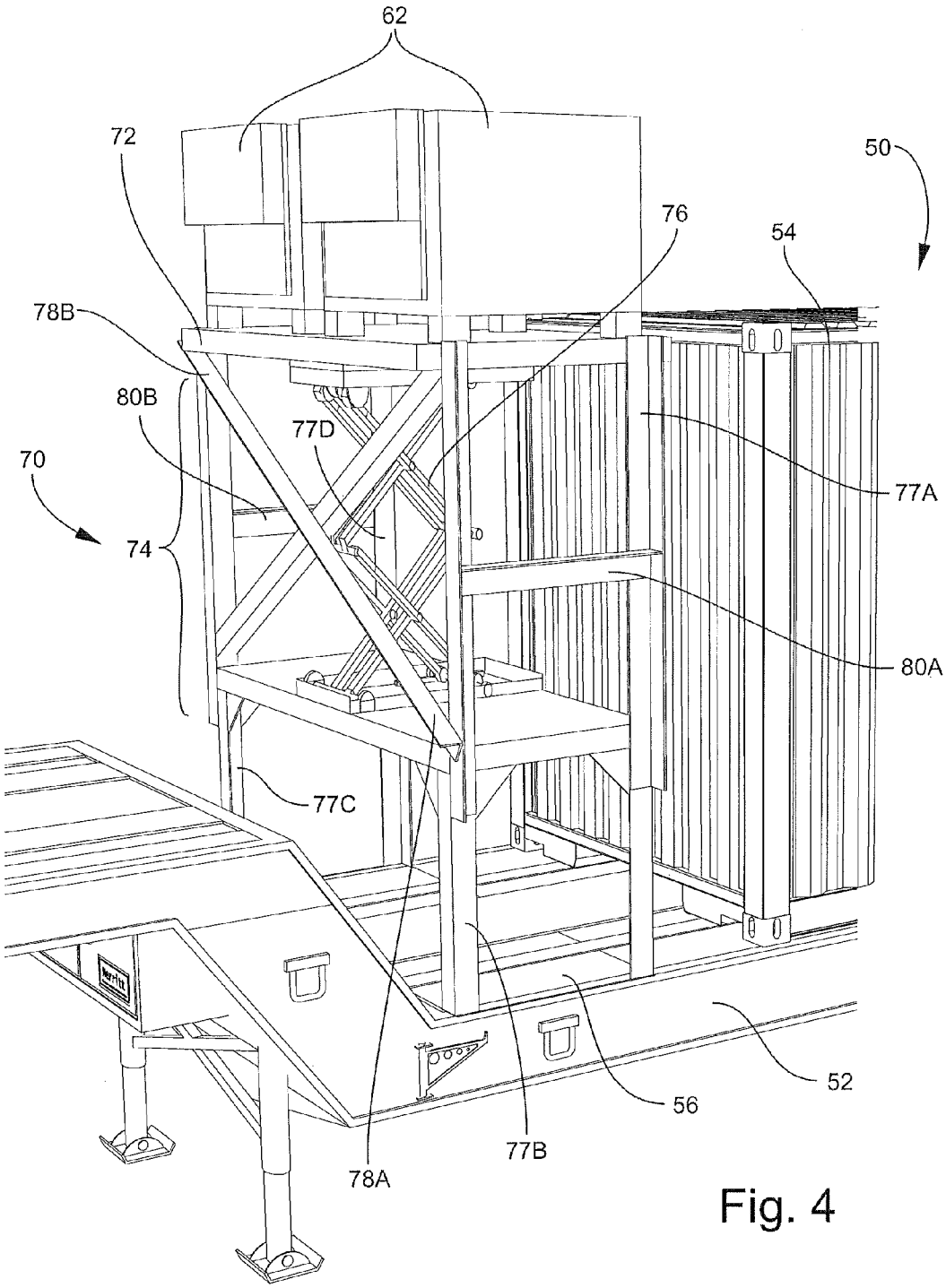
FIG. 4 is an enlarged perspective view similar to FIG. 3, showing the externally-mounted condensers in the raised, use position.
Figure 5:
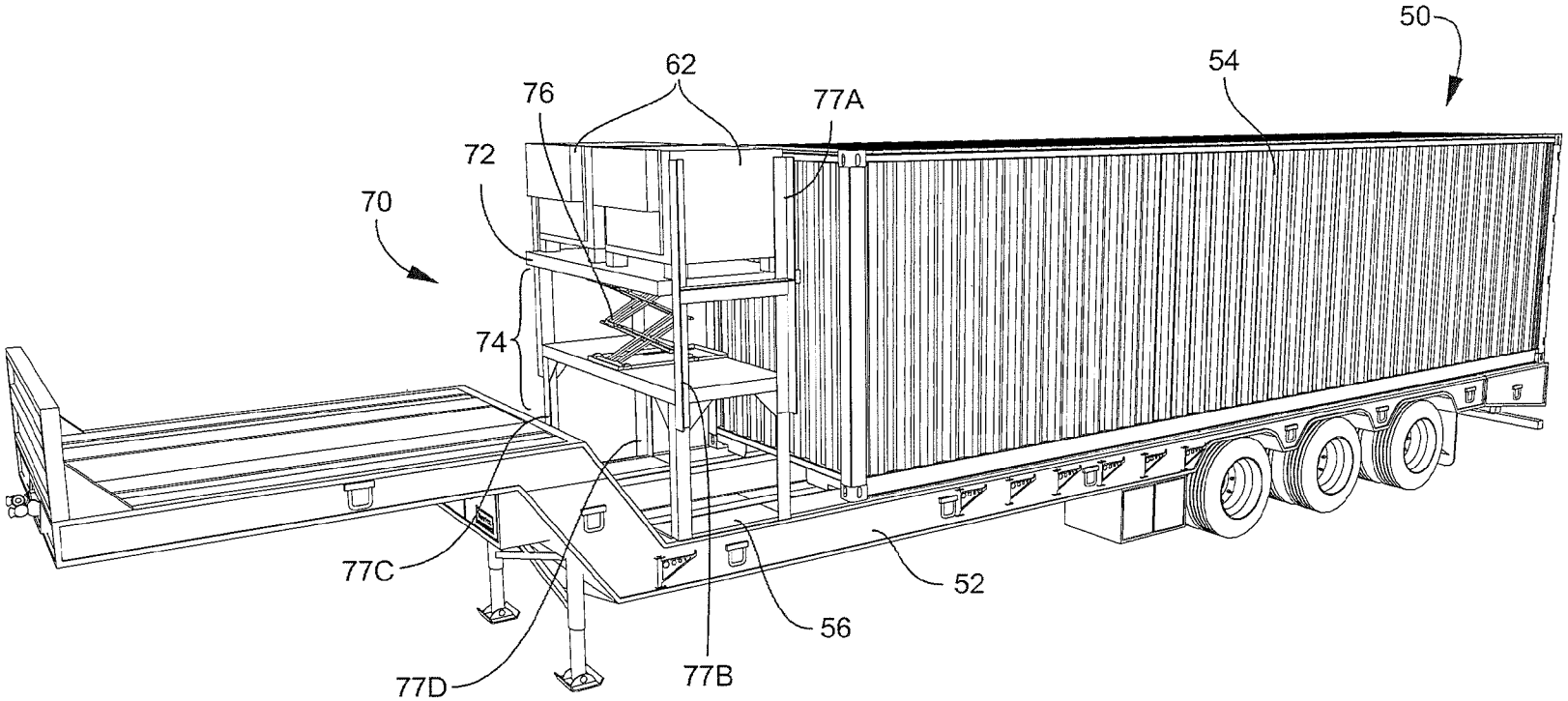
FIG. 5 is a perspective view of the trailer of FIG. 3, and showing the novel mechanism for raising and lowering the externally-mounted condensers in the lowered transport position.
Figure 6:
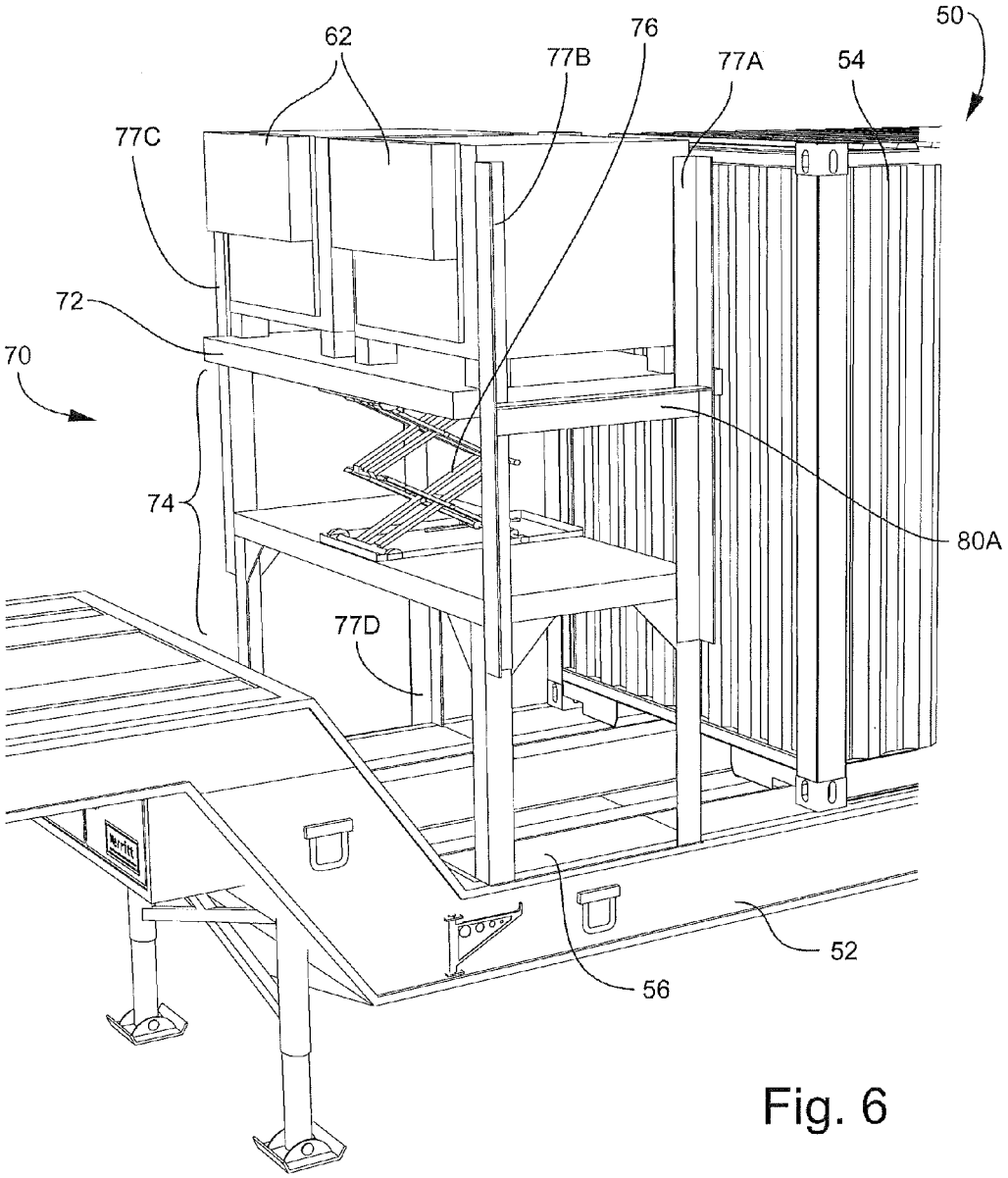
FIG. 6 is an enlarged perspective view similar to FIG. 5, showing the externally-mounted condensers in the lowered, transport position.

For this reason, the condensers 62 are mounted on a on a condenser lift 70 that is adapted to move the condenser 62 between a lowered, transport position in relation to the height of the trailer 50 to permit passage of the trailer 50 beneath highway overpasses, FIGS. 5 and 6, and a raised, use position in relation to the height of the trailer 50 to permit backflow of the refrigerant from the condensers 62 when the condensers 62 are not operating, FIGS. 3 and 4. The lift 70 includes a platform 72 mounted on a frame 74 carried by the trailer 50, and includes a scissor-type lift 76 mounted under the condensers 62 and platform 72 for moving the lift 76 vertically.

The lift 76 is hydraulically powered in a conventional manner. The frame 74 includes a plurality of guide rails 77A-D extending upwardly from the base 56 and engaging the platform 72 to guide its vertical travel. The upward motion of the lift 76 is achieved by the application of pressure to the outside of the lowest set of supports, elongating the crossing pattern, and propelling the platform 72 vertically. The contraction of the scissor action can be hydraulic, pneumatic or mechanical via a leadscrew or rack and pinion system. Depending on the power system employed on the lift 76, it may require no power to enter "descent" mode, but rather a release of hydraulic or pneumatic pressure.

When in its raised use position, cross-braces 78A-B are attached to and extend diagonally and laterally between the guide rails 77B and 77C to provide anti-racking support to the guide rails 77A-D and the condensers 62. Additional bracing elements 80A-B provide additional support to the frame 74. Also when in its raised use position, the platform 72 is bolted to the top of the guide rails 77A-77D in order to take load off of the lift 76.

Thus, the condensers 62 extend above an upper extent of the trailer 50 when in the raised, use position, FIGS. 3 and 4, and below an upper extent of the trailer 50 when in the lowered transport position, FIGS. 5 and 6.

A vehicle-transportable ice plant according to the invention have been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. A vehicle transportable ice plant, comprising:

(a) a transportable trailer including an enclosure;

(b) an evaporator positioned within the enclosure for supplying supercooled refrigerant to a heat exchanger, a compressor downstream from the evaporator for compressing the refrigerant, a discharge line downstream from the compressor for discharging compressed refrigerant to a condenser, a condenser fan for removing heat from the condenser, and a thermostatic expansion valve for delivering supercooled refrigerant to the evaporator in an endless cycle;

(c) an ice production apparatus for bringing water into contact with the evaporator heat exchanger to produce ice; and (d) an ice cube maker for producing ice cubes from the ice, wherein:

the condenser is mounted outside and laterally adjacent to the enclosure on a condenser lift of the transportable trailer;

the condenser lift includes a condenser platform mounted on a frame carried by the trailer and a scissor-type lift mounted under the condenser on a base carried by the trailer for moving the lift vertically between a lowered, transport position in relation to the height of the trailer to permit passage of the trailer beneath highway overpasses and a raised, use position in relation to the height of the trailer to permit backflow of the refrigerant from the condenser when the condenser is not operating:

the frame includes a plurality of guide rails extending upwardly from the base and engaging the condenser platform to guide its vertical travel, wherein the plurality of guide rails comprise four guide rails adapted to he attached to the condenser platform when the condenser is in the raised, use position to support the condenser platform in the raised, use position; and at least one cross-brace is attached to and extends diagonally and laterally between at least two of the guide rails to provide anti-racking support to the guide rails and condenser.

2. A vehicle transportable ice plant according to claim 1, and including a reservoir for storing the refrigerant when the condenser is not operating.

3. A vehicle transportable ice plant according to claim 1, wherein the condenser extends above an upper extent of the trailer when in the raised, use position.

4. A vehicle transportable ice plant according to claim 1, wherein the condenser extends below an upper extent of the trailer when in the lowered, transport position.

5. A vehicle transportable ice plant according to claim 1, wherein the condenser extends above an upper extent of the trailer when in the raised, use position and further wherein the condenser extends below the upper extent of the trailer when in the lowered, transport position.

6. A vehicle transportable ice plant, comprising:

(a) a transportable trailer including an enclosure;

(b) an evaporator positioned within the enclosure for supplying supercooled refrigerant to a heat exchanger, a compressor downstream from the evaporator for compressing the refrigerant, a discharge line downstream from the compressor for discharging compressed refrigerant to a condenser, a condenser fan for removing heat from the condenser, and a thermostatic expansion valve for delivering supercooled refrigerant to the evaporator in an endless cycle, the condenser being mounted outside the trailer on a condenser lift that is adapted to move the condenser between a lowered, transport position in relation to the height of the trailer to permit passage of the trailer beneath highway overpasses and a raised, use position in relation to the height of the trailer to permit backflow of the refrigerant from the condenser when the condenser is not operating;

(c) a platform mounted on a frame carried by the trailer, and a plurality of guide rails extending upwardly from a base and engaging the platform to guide its vertical travel;

(d) a scissor-type lift mounted under the condenser on base carried by the trailer for moving the lift vertically;

(e) an ice production apparatus for bringing water into contact with the evaporator heat exchanger to produce ice; and (f) an ice cube maker for producing ice cubes from the ice, wherein:

the guide rails comprise a plurality of guide rails adapted to be attached to the condenser platform when the condenser is in the raised, use position to support the condenser platform in the raised, use position, and including at least one cross-brace attached to and extending diagonally and laterally between at least two guide rails to provide anti-racking support to the plurality of guide rails and condenser.

7. A vehicle transportable ice plant according to claim 6, wherein the condenser extends above an upper extent of the trailer when in the raised, use position.

8. A vehicle transportable ice plant according to claim 6, wherein the condenser extends below an upper extent of the trailer when in the lowered, transport position.

9. A vehicle transportable ice plant according to claim 6, wherein the condenser extends above an upper extent of the trailer when in the raised, use position and further wherein the condenser extends below an upper extent of the trailer when in the lowered, transport position.

* * * * *